US006059598A

United States Patent [19]

Yamashita et al.

[11] Patent Number: 6,059,598

[45] Date of Patent: May 9, 2000

[54] CONNECTOR

[75] Inventors: Kazunori Yamashita; Yasuo Matsushita; Hiroki Osawa, all of Yokkaichi, Japan

[73] Assignee: Sumitomo Wiring Systems, Ltd., Yokkaichi, Japan

[21] Appl. No.: 09/030,445

[22] Filed: Feb. 25, 1998

[30] Foreign Application Priority Data

Feb. 26, 1997 [JP] Japan ..... 9-042312

[51] Int. Cl.[7] ..... H01R 13/627

[52] U.S. Cl. ..... 439/352; 403/326

[58] Field of Search ..... 439/352, 358, 439/357; 403/326, 329

[56] References Cited

U.S. PATENT DOCUMENTS

| | | | |
|---|---|---|---|
| 5,380,217 | 1/1995 | Yagi et al | 439/350 |
| 5,399,045 | 3/1995 | Yoneda et al. | 439/352 |
| 5,480,324 | 1/1996 | Maegawa et al. | 439/352 |
| 5,487,678 | 1/1996 | Tsuji et al. | 439/352 |
| 5,536,103 | 7/1996 | Sawada | 439/274 |
| 5,628,648 | 5/1997 | Higgins, Jr. et al. | 439/489 |
| 5,718,596 | 2/1998 | Inaba et al. | 439/352 |

FOREIGN PATENT DOCUMENTS

| | | |
|---|---|---|
| 0732775 | 9/1996 | European Pat. Off. . |
| 6-89756 | 3/1994 | Japan . |

OTHER PUBLICATIONS

Copy of a European Search Report, issued May 14, 1998 with EP App. No. 98 30 1426.

*Primary Examiner*—Michael L. Gellner
*Assistant Examiner*—Briggitte Hammond
*Attorney, Agent, or Firm*—Greenblum & Bernstein, P.L.C.

[57] ABSTRACT

A connector is provided in order to enhance a tactile sensation by providing a restoring force to a lock piece and further to attain an original locking function at the fitting of both a male and female connector housing. A dome covering the upper edge of a lock piece is formed on a female housing, and an arm which protrudes rearwardly and which can be elastically deformed is affixed to the dome. A projecting contact part protrudes downwardly at the end of the arm and closely contacts the upper edge of the lock piece. When the male and female housings are interfitted, a gaff part on the lock piece engages a protrusion on the male housing and swings upwardly, and in accordance with it, elastically deforms the arm by pushing the projecting contact part. When the male and female housings are normally interfitted, the lock piece restores to its original position and is locked by engagement of the gaff part with the backside of the protrusion. The lock piece forcefully restores to its original position by receiving the restoring elastic force of the arm, therefore causing the end of the gaff part to snap onto the upper face of the male housing to generate a loud sound and an enhanced tactile sensation.

20 Claims, 12 Drawing Sheets

CONNECTOR

BACKGROUND OF THE INVENTION

1. Field of the Invention

The present invention relates to a connector, and particularly relates to an improvement in the connecting structure of the connector for effecting a loud sound and a tactile sensation that can be felt by a worker who can thus recognize that the connection has been normally completed.

2. Description of Background Information

A connector is known in the prior art as depicted in FIG. 16. A connector of this kind is described in Japanese Patent Publication (Unexamined) HEI No. 6-89756. As shown in FIG. 16, this connector has a construction in which a lock piece (d) has a gaff part (b) and can swing about a fulcrum (c) like a seesaw. Lock piece (d) is affixed to the female housing, and on the other hand, a hooking projection (f) which can be hooked on the gaff part (b) of the above-mentioned lock piece (d) is affixed to an opposing male housing (e). When both housings (a) and (e) are intermitted, the lock piece (d) swings while the gaff part (b) rides over the hooking projection (f). After both the housings (a) and (e) are normally interfitted, both the housings (a) and (e) are designed to be locked together by hooking the gaff part (b) on the back face of the hooking projection (f) when the lock piece (d) returns to its normal position.

In this type of connector, it is desired to enhance a tactile sensation when both the housings (a) and (e) are normally interfitted. Therefore, in case of the above-mentioned connector, a connecting part is made in a rising shape at the edge side of the lock piece (d), which is integrally connected with a hood part (h) formed at the edge side of the housing (a), the restoring force of the lock piece (d) is accordingly set at a high level, thereby providing a mechanism for enhancing the above-mentioned tactile sensation.

Furthermore, according to the conventional connector, since the connecting part (g) which is raised from the lock piece (d) is integrally connected with the hood part (h) which is not easily deformed, the repetition of a locking operation easily causes plastic deformation of the connecting part (g). Therefore, there has been a concern that the locking function cannot be attained because the lock piece (d) cannot restore to its original position.

SUMMARY OF THE INVENTION

The present invention relates to a connector equipped with a lock piece. The connector of the present invention has been constructed to overcome the above-mentioned deficiencies and to enhance the tactile sensation by establishing a greater restoring force for the lock piece, and further to positively provide the original locking function.

In order to attain the above-mentioned purpose according to a first aspect of the present invention, the invention includes a connector having a biasing part which is elastically displaced by being pressed by a lock piece which moves obliquely. The biasing part functions to bias the fore-mentioned lock piece back to an original position by its elastic restoring force and is provided independently of the fore-mentioned lock piece in one of the connector housings.

In the connector, the fore-mentioned lock piece which can elastically and obliquely move is provided in one of a pair of connector housings which are mutually interfitted. The lock piece moves obliquely by passing over a protrusion which is provided on an opposing connector housing in accordance with the interfitting of both the connector housings, and returns to its original position when the connector housings are normally interfitted, and is designed to be hooked on the fore-mentioned protrusion.

In a second aspect of the present invention, the connector has a construction wherein in one of the connector housings, a dome covering the movable outside edge of the fore-mentioned lock piece is provided, and the fore-mentioned biasing part is formed in a cantilever arm shape which can be elastically deformed, and the cantilever arm shape is formed by cutting a portion of the fore-mentioned dome.

In a third aspect of the present invention, the connector has a construction wherein in one of the connector housings, a dome covering the outside of the edge of oblique movement of the fore-mentioned lock piece is provided, and the fore-mentioned biasing part is formed in a bridge shape which projects inwardly from the inner face of the fore-mentioned dome so that elastic deformation is possible.

According to a further aspect of the present invention, when both connector housings are intermitted, a lock piece obliquely moves while elastically displacing a biasing part, and when the housings are normally fitted together, the lock piece returns to its original position by being aided by the restoring elastic force of the biasing part. The restoring elastic force of the biasing part aids the return of the lock piece, therefore the tactile sensation can be enhanced. Further, as the biasing part is made independently of the lock piece, there is little danger of plastic deformation, and the lock piece positively provides the locking function.

According to another aspect of the present invention, a lock piece obliquely moves while elastically deforming an arm shaped biasing part provided on a dome. The hooking part of the lock piece is protected by the dome, and in addition, since the biasing part is formed in an arm shape by cutting a portion of the dome, the structure is easily formed.

According to an additional aspect of the invention, a lock piece obliquely moves while elastically deforming a bridge shaped biasing part formed on the inner face of a dome. Thus, the function for aiding the return of the lock piece can be provided while maintaining the integrity of the dome which protects the hooking part of the lock piece.

BRIEF DESCRIPTION OF THE DRAWINGS

The invention will be described below in detail with reference to the accompanying drawings in which similar elements are indicated by similar reference numerals, and wherein.

DETAILED DESCRIPTION OF THE PREFERRED EMBODIMENTS

The construction and mode of operation of the present invention are illustrated below according to the figures of the drawings.

Figure 1:
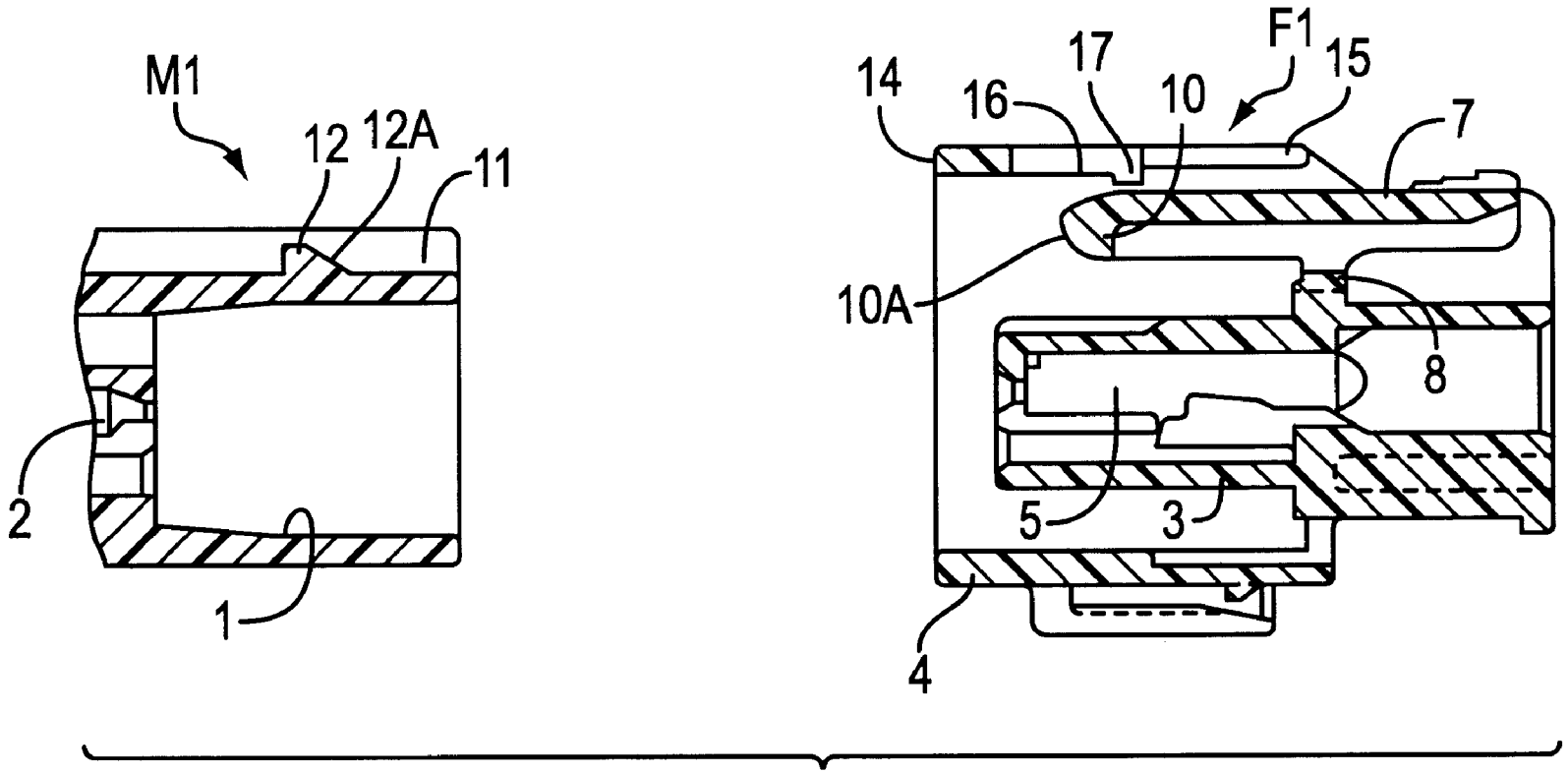
FIG. 1 is a cross-sectional view of the male and female housings before the housings are interfitted according to the first embodiment of the present invention.
Figure 2A:
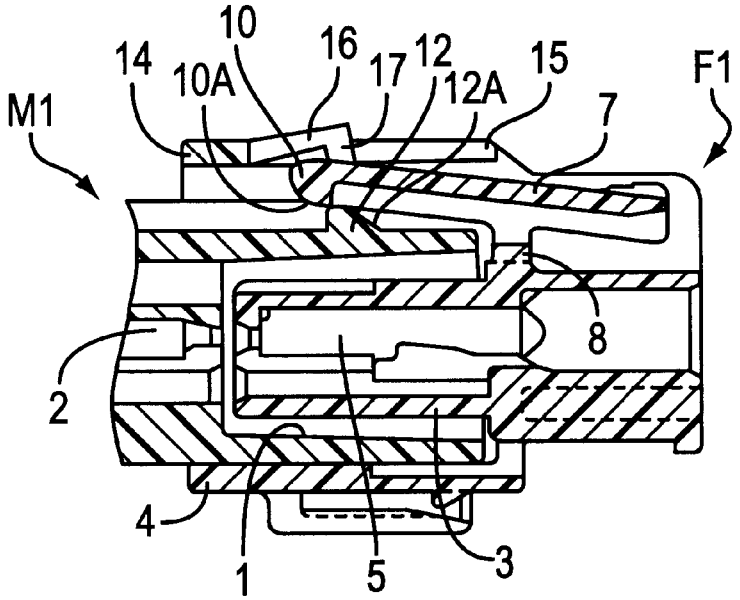
FIG. 2(A) is a cross-sectional view of the first embodiment as the housings are fitted together.
Figure 2B:
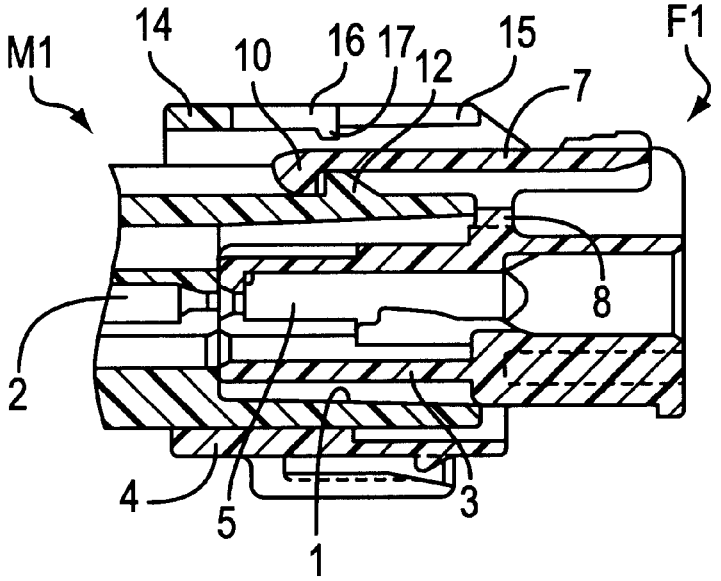
FIG. 2(B) is a cross-sectional view of the first embodiment showing the housings after interfitting has been completed.
Figure 3:
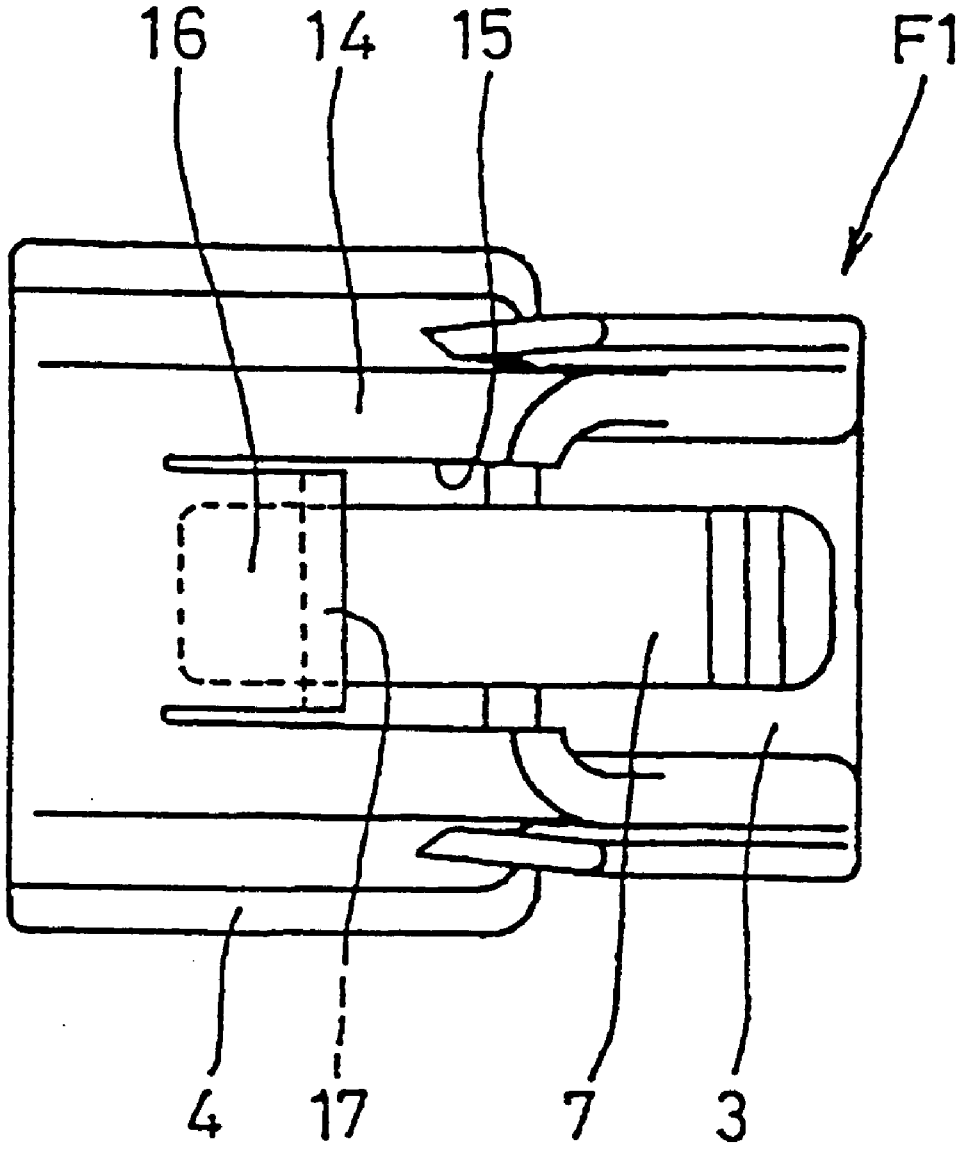
FIG. 3 is a plan view of the female housing of the first embodiment of the present invention.

A first embodiment of the present invention is illustrated in accordance with FIGS. 1–3. The connector of the first embodiment is equipped with a male connector housing M1 (hereinafter referred to as a male housing) and a female connector housing F1 (hereinafter referred to as a female housing) which are to be mutually fitted together.

The male housing M1 is formed of a synthetic resin material, and a fitting recess 1 is formed at a front side with a fitting face having a plurality of cavities 2. A plurality of male-type terminal fittings (which are not shown in the figure) are housed in corresponding cavities 2, and respective tabs 32 (FIG.4) protrude in a row in the fitting recess 1.

The female housing F1 is similarly formed of a synthetic resin material, and is equipped with a hood part 4 which surrounds the front edge side of a main body part 3 (left side of FIG. 1). The above-mentioned male housing M1 is fitted in the inside of hood part 4, and the front edge of the main body part 3 is designed to be inserted into the fitting recess of the male housing 1. Female-type terminal fittings 33 (FIG.4) are respectively housed in cavities 5 which are formed in the main body part 3, and when both the housings M1 and F1 are fitted together, the corresponding male and female terminal fittings are designed to be mutually interfitted and connected.

A locking structure for locking the housings M1 and F1 together is provided between them. Therefore, a lock piece 7 is provided at the central part in the transverse direction of the upper face of the main body part 3 in the female housing F1 as seen in FIG. 3. This lock piece 7 is formed to have an elongated shape in the longitudinal direction and is thin in cross-section. The lock piece has downwardly depending side walls which, at about the central part of the longitudinal direction, are integrally connected with the main body part 3 through a fulcrum. Thus, the lock piece 7 can swing about the fulcrum 8 in a seesaw manner.

The front edge of the lock piece 7 is enlarged to form a gaff part 10 for hooking engagement with a projection 12 on the male housing. The front face of the gaff part 10 has a tapered face 10A. On the other hand, a pair of guide walls 11 for guiding the movement of the above-mentioned lock piece 7 are provided on the upper face of the male housing M1. The projection 12, which can be hooked by the gaff part 10 of the lock piece 7, is provided between the guide walls. The front face of the protrusion 12 which comes into contact with the front face of the gaff part 10 has a tapered face 12A. Thus, when the male housing M1 is inserted into the female housing F1, the gaff part 10 of the lock piece 7 engages with the protrusion 12, and the tapered face 10A of the gaff part 10 rides along the tapered face 12A causing the lock piece 7 to swing in a clockwise direction as seen in FIG. 2(A). When both housings M1 and F1 are normally fitted together, as the gaff part 10 moves past the protrusion 12, the lock piece 7 restores to its original position and the gaff part 10 is hooked on the back face of the protrusion 12 to lock the housings together as seen in FIG. 2(B).

The upper face of the hood part 4 of the female housing F1 includes a dome 14 in which the central part in the axial direction corresponding to the upper side of the lock piece 7 is raised by one step. The dome 14 protects the gaff part of the lock piece 7 and the protrusion 12 from impact from the outside. Longitudinal grooves 15 are formed in the dome 14. The grooves 15 are formed by notching or cutting from the rear edge of the housing F1 to a point just short of the front edge as seen in FIGS. 1 and 3. A cantilever type arm 16 for biasing the lock piece and which can be elastically deformed is provided rearwardly from the front edges of, and between, the grooves 15 as shown in FIG. 3. A projecting contact part 17 extends downwardly from the free end of arm 16 to a position adjacent the upper face of the edge part of the lock piece 7, as seen in FIG. 1.

A first mode of operation of the connector of the first embodiment of the present invention is illustrated in FIGS. 1 and 2. When the housings M1 and F1 are fitted together from the state of FIG. 1, the gaff part 10 of the lock piece 7 engages with the protrusion 12, and the tapered face 10A of the gaff part 10 rides along the tapered face 12A of the protrusion 12 as shown in FIG. 2(A), causing the lock piece 7 to swing in a clockwise direction as also seen in FIG. 2(A). The upper surface of lock piece 7 is raised and thus pushes the projecting contact part 17 of arm 16 in accordance with the swinging movement of the lock piece 7 and resiliently deforms the biasing arm 16 in an upward direction.

Further, when both housings M1 and F1 are in the normal interfitted state, the gaff part 10 of the lock piece 7 moves past the hooking part 12. Then, the lock piece 7 restores to its original position as shown in FIG. 2(B), and the gaff part 10 is locked in position by hooking on the back face of the protrusion 12. The lock piece 7 is forcefully restored to its original position by the elastic restoring force of the biasing arm 16 which had been elastically deformed, in addition to the elastic restoring force of the lock piece 7 itself. Therefore, the end of the gaff part 10 of the lock piece 7 snaps onto the upper face of the male housing M1 to generate a loud sound and a tactile sensation that can be felt by a worker who can thus recognize that the connection has been completed.

Furthermore, unlocking of the connector can be performed by applying strong pressure to the back edge of the lock piece 7 to swing it in the clockwise direction. Thus, the gaff part 10 is removed from the protrusion 12 while the biasing arm 16 is forced to elastically deform by bending, and therefore the connector is unlocked. On the other hand, when the lock piece 7 is inadvertently moved in an unlocking direction, additional resistance to restrain the movement is provided by the biasing arm 16. Therefore, the biasing arm 16 functions as a simple double locking member.

As illustrated above, according to the first mode of operation of the present invention, the elastic restoring force of the arm 16 aids the returning movement of the lock piece 7, and acts to forcefully throw or snap the gaff part 10 of the lock piece 7 onto the upper face of the male housing M1 producing a loud sound and a tactile sensation. Further, since the biasing arm 16 is formed independently of the lock piece 7, there is little danger of plastic deformation, and the lock piece 7 will positively provide the locking function. Furthermore, since the biasing arm 16 is formed by notching or cutting a portion of the dome 14, the structure is easily formed.

Figure 4:
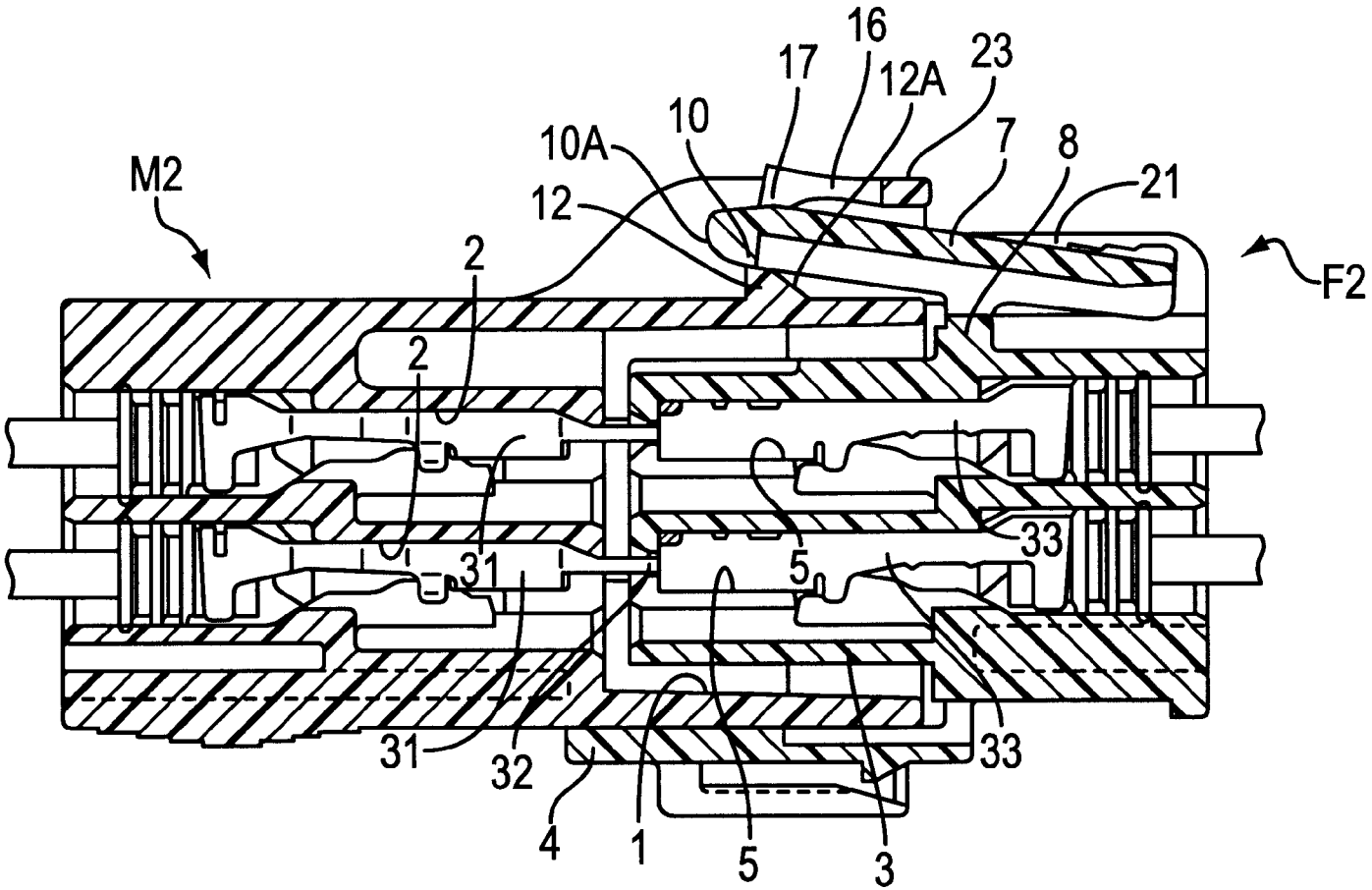
FIG. 4 is a cross-sectional view of the intermediate position of the housings in accordance with a second embodiment of the present invention.

A second embodiment of the present invention is illustrated in FIGS. 4–7 of the drawings. The connector of the second embodiment includes a male housing M2 and a female housing F2 as shown in FIG. 4. As the basic structure of both the housings M2 and F2 is the same as the housings M1 and F1 of the above-mentioned first embodiment, the corresponding parts having the same function are simply illustrated while suitably having the same reference numerals.

In the male housing M2, the fitting recess 1 is formed at a front side with a 10 fitting face having a plurality of cavities 2. A plurality of the male-type terminal fittings 31 are housed in corresponding cavities 2, and respective tabs 32 protrude in a row in the fitting recess 1.

The female housing F2 is equipped with a hood part 4 which surrounds the front edge of a main body part 3 (as shown in FIG. 4). Longitudinal grooves 21 are formed at the central part in the transverse direction of the upper face side of the hood part 4. The male housing M2 is inserted within the hood part 4, and the front edge of the main body part 3 is designed to be inserted into the fitting recess 1 of male housing M2. Female-type terminal fittings 33 are respectively housed in cavities 5 which are formed in the main body part 3, and when both the housings M2 and F2 are fitted together, the corresponding male and female terminal fittings 31 and 33 are designed to be mutually interfitted and connected.

A locking structure equipped with a lock piece 7 is provided on the upper face of the main body part 3 in the female housing F2 at the position corresponding with the longitudinal grooves 21. This lock piece 7 has a U-shaped transverse cross-section and a gaff part 10 is formed by enlarging the front edge thereof. The lock piece 7 can swing about the fulcrum 8 in a seesaw manner, which fulcrum 8 is positioned at about a central part of the length thereof. On the other hand, a protrusion 12, which can be hooked on the gaff part 10 of the above-mentioned lock piece 7, is provided on the upper face of the male housing M2. The contact faces of the protrusion 12 and the gaff part 10 are respectively the tapered faces 12A and 10A.

Figure 5:
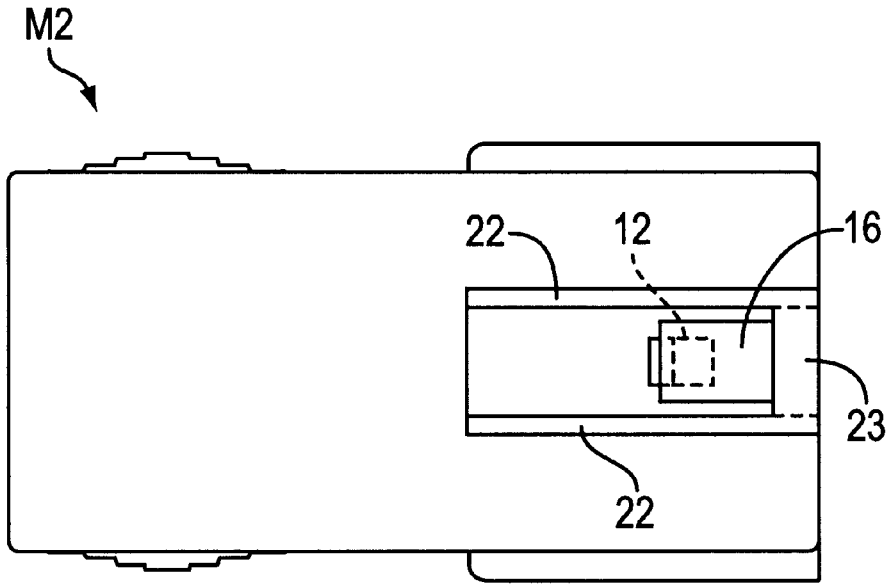
FIG. 5 is a plan view of the male housing in accordance with the second embodiment of the present invention.
Figure 6:
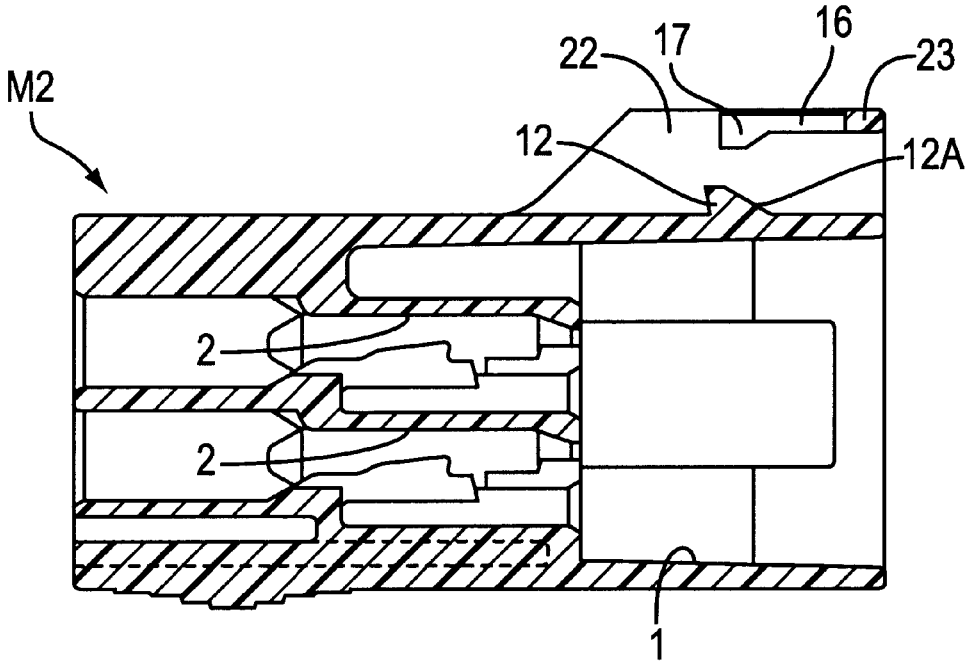
FIG. 6 is a cross-sectional view of the male housing according to the second embodiment of the present invention.
Figure 7:
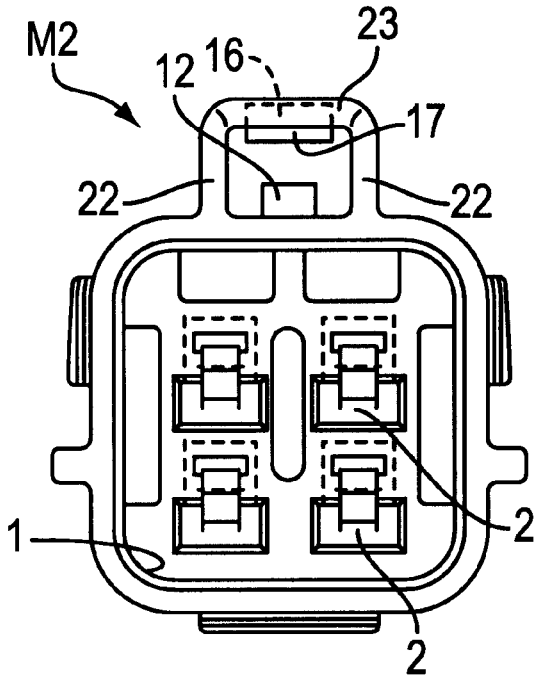
FIG. 7 is a front view of the male housing according to the second embodiment of the present invention.

In the second embodiment, a biasing arm 16 for pressing against the lock piece 7 is provided on the upper side of the male housing M2 as clearly seen in FIG. 7. In particular, a pair of guide walls 22 extend longitudinally on either side of the above-mentioned protrusion 12, on the upper side of the front edge of the male housing M2 as shown in FIGS. 5–7. The guide walls 22 are designed to guide the fitting by being fitted in the longitudinal grooves 21 of the hood part 4 in the female housing F2. A cross-piece 23 is formed between the upper edges of the front rim of the two guide walls 22 as shown in FIG. 7. The biasing arm 16 for pressing against lock piece 7 can be elastically deformed, and is cantilevered rearwardly from the central part of the back side of the cross-piece 23. The edge of the biasing arm 16 extends toward the above-mentioned protrusion 12, and a projection 17 protrudes downwardly at the end edge of the arm 16.

The mode of operation of the second embodiment of the present invention is as follows. When the housings M2 and F2 are interfitted, the gaff part 10 of the lock piece 7 engages with the protrusion 12, and the tapered face 10A of the gaff part 10 rides along the tapered face 12A of the protrusion 12 as shown in FIG. 4 causing the lock piece 7 to swing in a clockwise direction as seen in FIG. 4. The biasing arm 16 provided on the male housing M2 engages with the upper surface of the lock piece 7, the upper surface of the lock piece 7 is raised and thus pushes the projection 17 of arm 16 in accordance with the swinging movement of the lock piece 7 and resiliently deforms the biasing arm 16 in an upward direction.

Further, when both housings M2 and F2 are fitted together in the normal fitting state, the gaff part 10 of the lock piece 7 moves past the protrusion 12. Thereafter, the lock piece 7 restores to its original position and the gaff part 10 is locked in position by hooking on the back face of the protrusion 12. Then, the lock piece 7 is forcefully restored to its original position by the elastic restoring force of the biasing arm 16 which had been elastically deformed, in addition to the elastic restoring force of the lock piece 7 itself. Therefore, the edge of the gaff part 10 of the lock piece 7 snaps onto the upper face of the male housing M2 to generate a loud sound and a tactile sensation that can be felt by a worker who can thus recognize that the connection has been completed.

In the same manner as in the first mode of operation, the elastic restoring force of the biasing arm 16 aids the returning movement of the lock piece 7 and acts to forcefully throw or snap the gaff part 10 of the lock piece 7 onto the upper face of the male housing M2 causing a loud sound and an enhanced tactile sensation. Furthermore, since the biasing arm 16 is formed independently of the lock piece 7, there is little danger of plastic deformation, and the lock piece 7 will positively provide the locking function.

Figure 8:
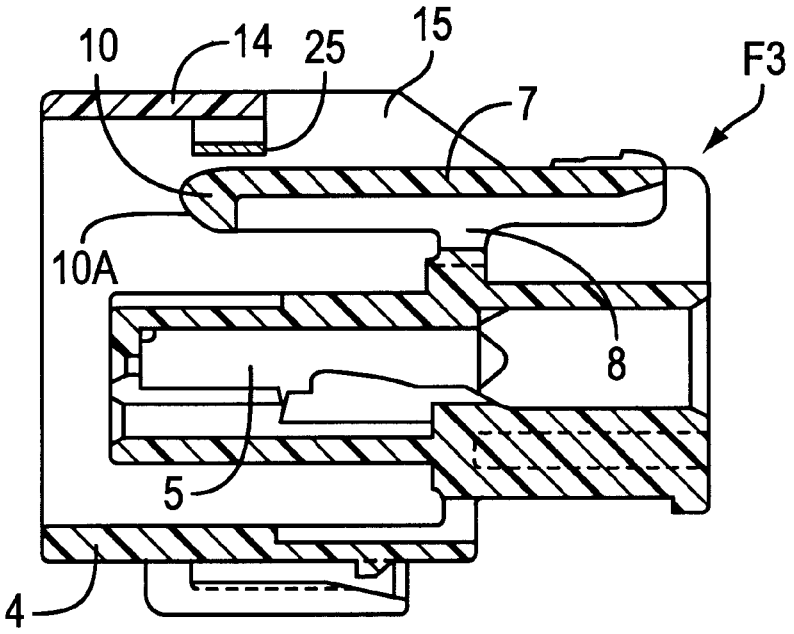
FIG. 8 is a cross-sectional view of the female housing according to the third embodiment of the present invention.
Figure 9:
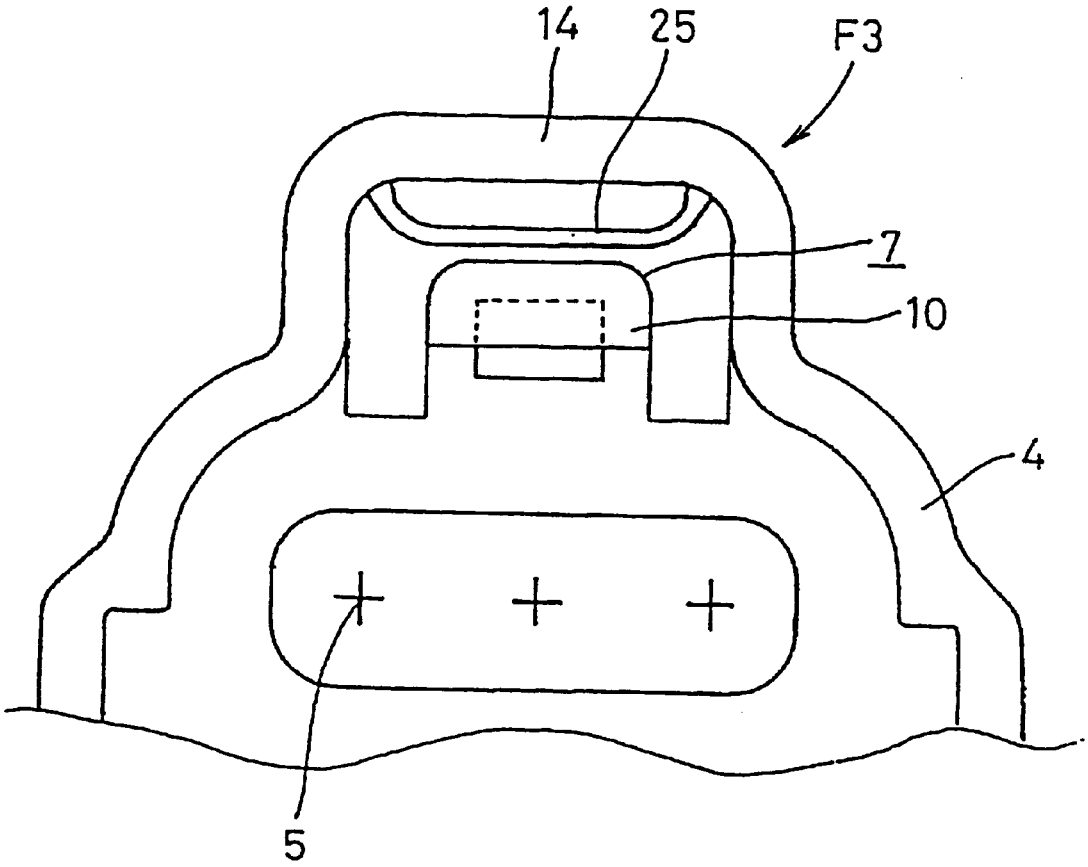
FIG. 9 is a partial front view of the female housing depicted in FIG. 8.
Figure 10:
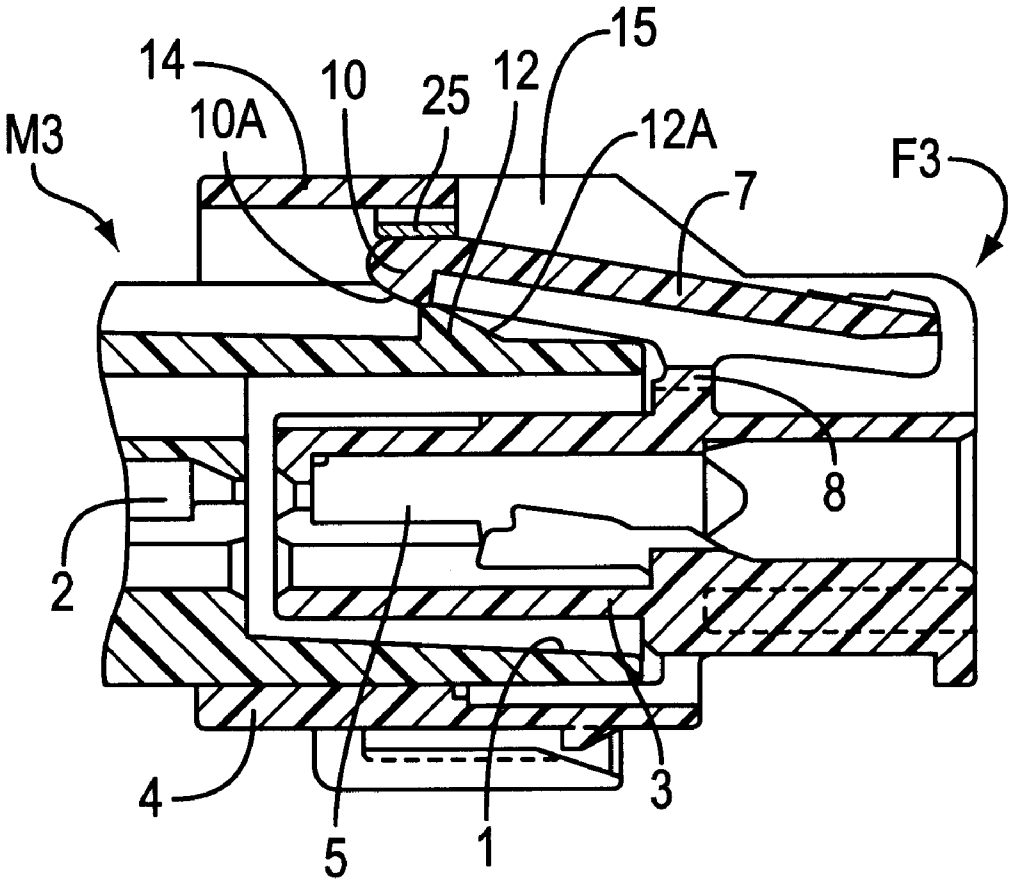
FIG. 10 is a cross-sectional view of the intermediate position of the housings.
Figure 11:
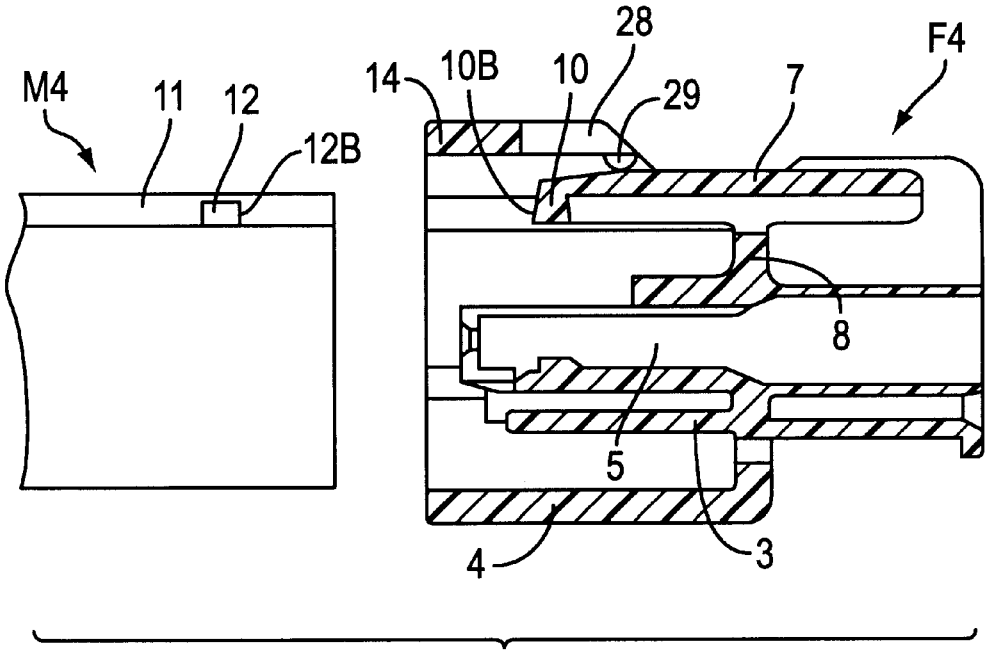
FIG. 11 is a cross-sectional view of the male and female housings before the housings are fitted together according to the fourth embodiment of the present invention.

A third embodiment of the present invention is illustrated in FIGS. 8–10 of the drawings. The third embodiment of the invention is a modified version of the fore-mentioned first embodiment of the present invention. That is, as shown in FIGS. 8 and 9, a biasing piece 25 is formed on the lower face of the dome 14 which is provided on the upper face of the hood part 4 of the female housing F3. The biasing piece 25 has a bridge shape that extends downwardly toward the upper surface of the lock piece 7 and is formed transversely to the lock piece 7. The other structure of the connector is the same as that of the fore-mentioned first embodiment of the invention, and the duplicate discussion of the parts having the same function and reference numerals is omitted.

The mode of operation of the third embodiment is as follows. When the housings M3 and F3 are interfitted, the gaff part 10 of the lock piece 7 engages with the protrusion 12, rides up on the protrusion 12 as shown in FIG. 10, and the lock piece 7 swings in a clockwise direction as seen in FIG. 10. Accordingly, the upper surface of the lock piece 7 is raised and thus pushes the central part of the biasing piece 25 upwardly and elastically deforms it to a substantially flat condition.

When the housings M3 and F3 are in the normal fitting condition, the gaff part 10 of the lock piece 7 moves past the protrusion 12. Thereafter, the lock piece 7 restores to its original position and the gaff part 10 is locked in position by hooking on the back face of the protrusion 12. Then, the lock piece 7 is forcefully restored to its original position by the elastic restoring force of the biasing piece 25 which has been elastically deformed, in addition to the elastic restoring force of the lock piece 7 itself. Therefore, the edge of the gaff part 10 of the lock piece 7 snaps onto the upper face of the male housing M3 to generate a loud sound and a tactile sensation.

Thus, the elastic restoring force of the biasing piece 25 and the tactile sensation can both be enhanced. Furthermore, since the biasing piece 25 is formed independently on the lock piece 7, there is little danger of plastic deformation. Additionally, as the biasing piece 25 is formed in a bridge shape under the lower face of the dome 14, the dome 14 itself is retained without deformation.

A fourth embodiment of the present invention is illustrated according to FIGS. 11–15. The fourth embodiment is a case in which the present invention is applied to a connector by adopting an inertia-locking type locking structure. The basic structure of the housing is the same as the fore-mentioned first embodiment, and duplicate discussion of parts having the same function is omitted, and like parts have been given the same reference numerals.

In order to constitute the inertia-locking, a contact face 10B of the gaff part 10 of the lock piece 7 formed in the female housing F4 and a contact face 12B of the protrusion 12 formed in the male housing M4 are respectively formed in a substantially vertical plane. In this embodiment, the gaff part 10 mounts on the protrusion 12 with difficulty, and a great force is required for mounting it. The force required for mounting the gaff part 10 on the hooking part 12 in this embodiment is selected to be greater than the peak frictional force when the male and female terminal fittings are mutually intermitted, etc. If only the gaff part 10 of the lock piece 7 is mounted on the protrusion 12 by squeezing the back of the female housing F4, then the female housing F4 is pushed in to the normal interfitting position by force of inertia, the male and female terminal fittings are normally fitted in and connected, and both the housings M4 and F4 are mutually locked.

Figure 14:
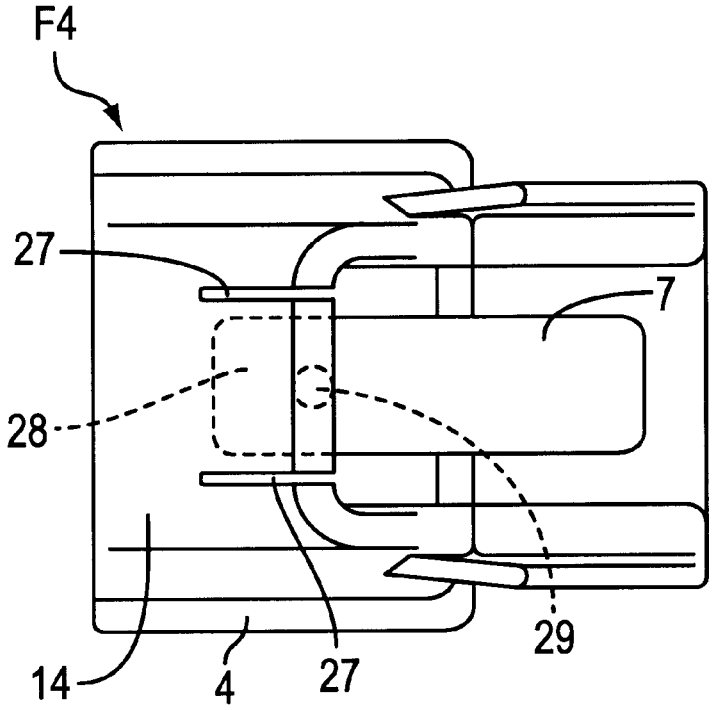
FIG. 14 is a plan view of the female housing of the fourth embodiment of the present invention.
Figure 15:
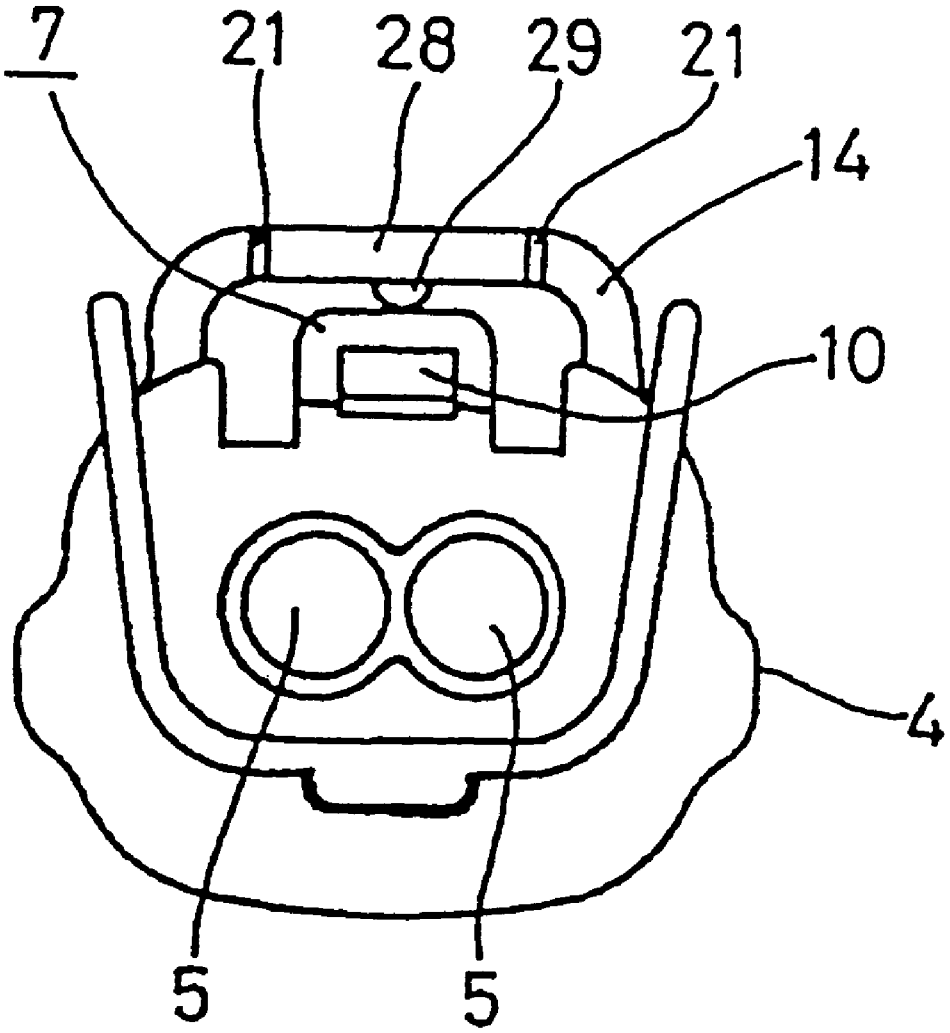
FIG. 15 is a rear view of the female housing of the fourth embodiment of the present invention.
Figure 16:
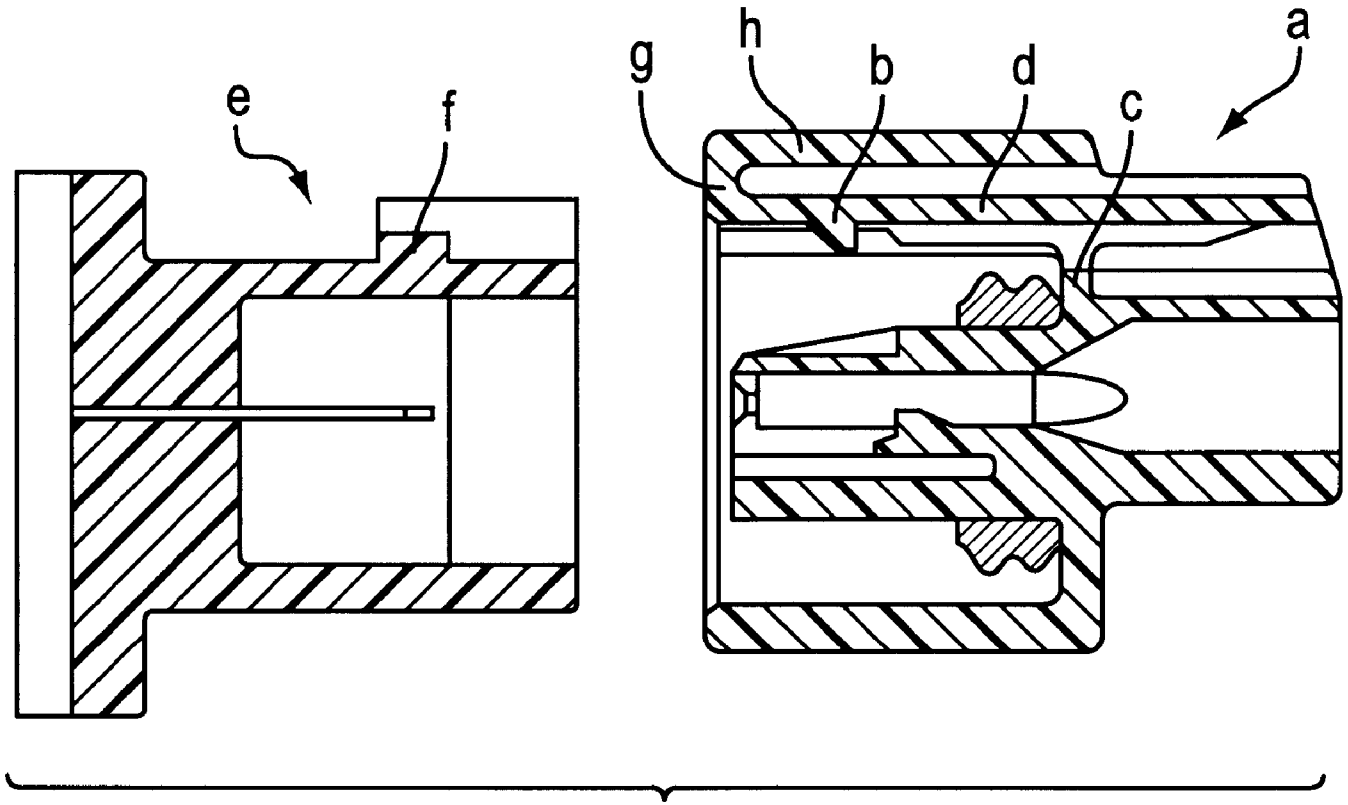
FIG. 16 (PRIOR ART)
FIG. 16 is a cross-sectional view of a prior art connector.

In the fourth embodiment, the dome 14 is enhanced by a step formed on the upper face of the hood part 4 of the female housing F4. Two slits 27 are formed in the longitudinal direction on the upper surface of the dome 14, and an arm 28 for biasing the lock piece 7 is formed as a cantilever which can be elastically deformed and which protrudes rearwardly as shown in FIGS. 14 and 15. A hemispherical type projecting contact part 29 protrudes downwardly at the end of the biasing arm 28 to contact the upper face of the lock piece 7.

Figure 12:
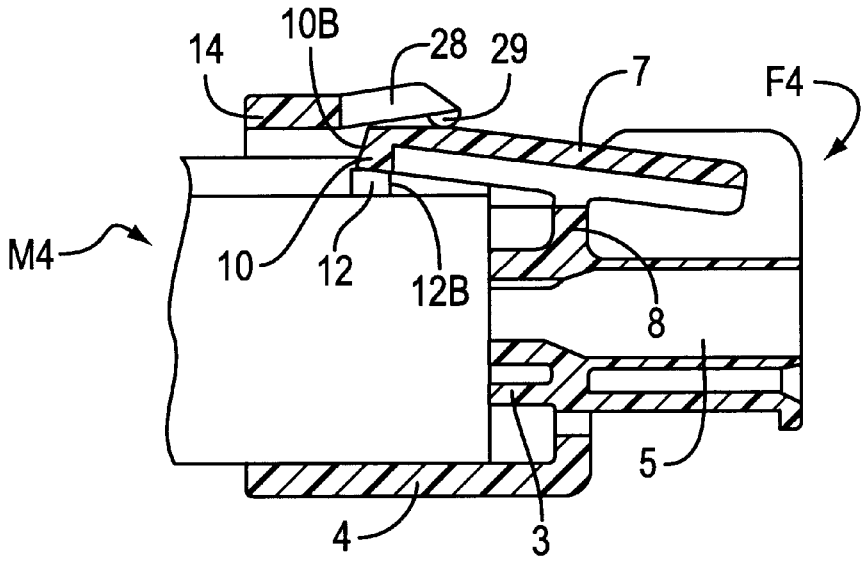
FIG. 12 is a cross-sectional view of the housings of FIG. 11 in an intermediate position thereof.
Figure 13:
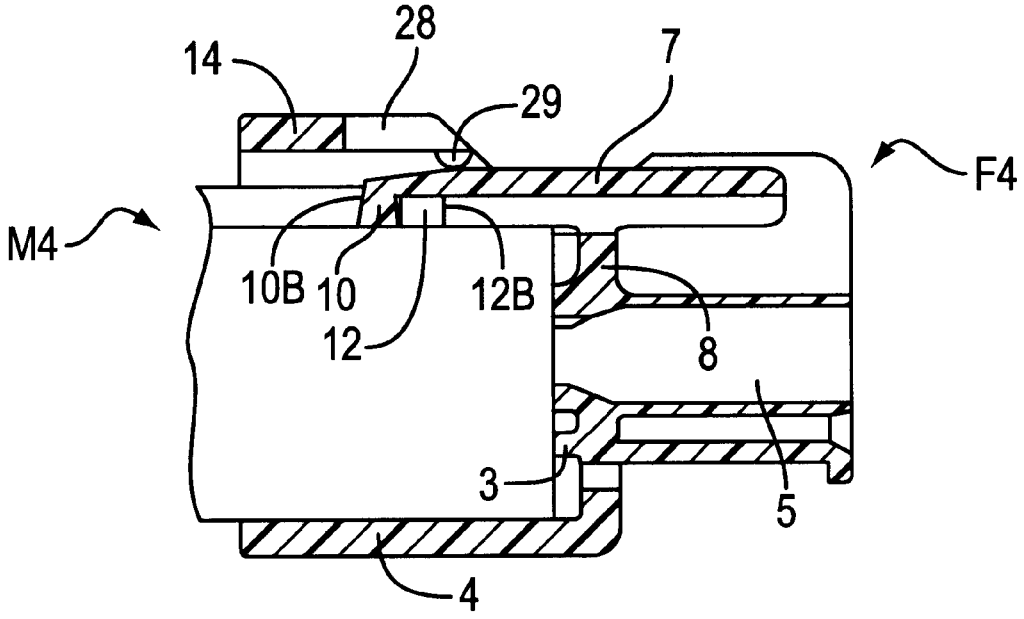
FIG. 13 is a cross-sectional view of the fourth embodiment showing the housings after the fitting has been completed.

The operation of the fourth embodiment is as follows. When the housings M4 and F4 are fitted together, the gaff part 10 of the lock piece 7 engages with the protrusion 12, mounts the protrusion 12 while receiving a great resistance as shown in FIG. 12, and the lock piece 7 swings in the clockwise direction of the same figure.

In accordance with the swinging movement of the lock piece 7, the edge of the lock piece 7 raises, pushes the projecting contact part 29, and elastically deforms the biasing arm 28 upwardly.

As described above, after the gaff part 10 of the lock piece 7 is mounted on the protrusion 12, the female housing F4 is pushed toward the normal interfitting position by force of inertia. Then, as the gaff part 10 of the lock piece 7 extends past the protrusion 12, the lock piece 7 restores to its original position and the gaff part 10 is locked by hooking on the back face of the protrusion 12. Thus, the lock piece 7 forcefully restores to its original position by receiving the restoring elastic force of the biasing arm 28 which has been elastically deformed, in addition to the restoring elastic force of the lock piece 7 itself. Therefore, the edge of the gaff part 10 of the lock piece 7 is forcefully thrown onto, or snaps onto, the upper face of the male housing M4 to generate a loud sound and a tactile sensation that can be felt by a worker who can thus recognize that the connection has been normally completed.

In the inertia-locking type connector of this embodiment, the elastic restoring force of the biasing arm 28 aids the returning movement of the lock piece 7 and acts to forcefully throw the gaff part 10 of the lock piece 7 onto the upper face of the male housing M4, and the tactile sensation can be enhanced. Further, as the biasing arm 28 is formed independently of the lock piece 7, there is little danger of plastic deformation, and the lock piece 7 positively provides the locking function. Further, when the inertia-locking type is adopted, there is little danger that both housings M4 and F4 are left in a partially connected condition. For example, when the female housing F4 is pushed in to a position in which the lock piece 7 is previously squeezed in the unlocking direction, the inertia-locking does not function and it may be left in a partially connected condition while the gaff part 10 of the lock piece 7 is mounted on the protrusion 12. On the contrary, according to the present embodiment, as the biasing arm 28 provides a resistance to the oblique movement of the lock piece 7 and the lock piece 7 is moved with difficulty, the lock piece 7 is prevented from being inadvertently squeezed in the unlocking direction before the fitting operation and the inertia-locking is to be established.

Further, if both housings are left in a partially connected condition, they will be in a condition in which the edge of the biasing arm 28 protrudes upwardly, therefore the partial connection can be detected by visibly recognizing this condition.

The present invention is not limited by the embodiments illustrated according to the description and figures described above, and, for example, the following mode of operation is included in the technical range of the present invention, and further variations can be practiced within the scope of the invention in addition to the following:

(1) As exemplified in the third embodiment of the present invention, a structure equipped with the bridge type biasing piece can be also applied to a case wherein the biasing part is provided at the housing side which is equipped with the protrusion, as in the second embodiment of the invention.

(2) In the above-mentioned respective embodiments, the lock piece which swings in a seesaw manner by positioning the central part of the length thereof as a fulcrum was exemplified, but it can also be applied to one equipped with the cantilever type lock piece which elastically moves obliquely.

Although the invention has been described with reference to particular means, materials and embodiments, it is to be understood that the invention is not limited to the particulars disclosed and extends to all equivalents within the spirit and scope of the claims. The present disclosure relates to subject matter contained in priority Japanese Application No. HEI-9-0423 12, filed on Feb. 26, 1997, which is herein expressly incorporated by reference in its entirety.

What is claimed:

1. An electrical connector comprising a pair of housings that interfit with one another to form the connector, one of said housings including a resilient lock piece connected thereto for elastic and pivotal movement, and the other of said housings including a protrusion that engages with said lock piece to retain said housings in an interfitted condition;

a biasing part provided on one of said housings, said biasing part including a contact part positioned closely adjacent but spaced from said lock piece and being elastically deformable by pivotal movement of said lock piece in one direction;

wherein when said housings are fitted together, said lock piece is deflected in the one direction by said protrusion to engage and elastically deform said biasing part so that said biasing part provides an elastic restoring force to said lock piece, in addition to a restoring force of the lock piece itself, which biases said lock piece to an original position when said pair of connector housings are normally fitted together.

2. The electrical connector according to claim 1, wherein a dome covering a movable outside edge of said lock piece is provided on one of said connector housings and said biasing part is formed as a cantilever arm which can be elastically deformed, said cantilever arm formed by cutting a portion of said dome.

3. The electrical connector according to claim 1, wherein a dome covering a movable outside edge of said lock piece is provided on one of said connector housings, said biasing part is formed in a bridge shape which protrudes inwardly from the inner face of said dome so that elastic deformation is possible.

4. An electrical connector comprising first and second housings adapted to be interfitted, said first housing including an elongated resilient lock piece and said second housing including a protrusion for engagement by said lock piece to thereby retain said housings in locking engagement, and, one of said first and second housings including a biasing part including a contact part positioned closely adjacent but spaced from said lock piece, said biasing part resiliently engaging said lock piece during interfitting of said housings to enhance said locking engagement.

5. The electrical connector according to claim 4, wherein said one housing includes a dome that extends over and protects said lock piece.

6. The electrical connector according to claim 5, wherein said biasing part is formed as a cantilever arm on said one housing.

7. The electrical connector according to claim 6, wherein said cantilever arm is formed by slitting said dome.

8. The electrical connector according to claim 5, wherein said biasing part is formed to have a bridge shape.

9. The electrical connector according to claim 8, wherein said bridge shaped biasing part projects inwardly from an inner face of said dome.

10. The electrical connector according to claim 4, wherein said biasing part is provided on said first housing.

11. The electrical connector according to claim 10, wherein said biasing part is formed as a cantilever arm on said first housing.

12. The electrical connector according to claim 11, wherein said cantilever arm is formed by slitting said dome.

13. The electrical connector according to claim 4, wherein said biasing part is formed on said second housing.

14. The electrical connector according to claim 13, wherein said biasing part is formed as a cantilever arm on said second housing.

15. The electrical connector according to claim 14, wherein said cantilever arm is formed by slitting said dome.

16. The electrical connector according to claim 4, wherein said lock piece includes an enlarged hooking portion, and said lock piece is obliquely elastically deflected during interfitting of said first and second housings until said hooking portion of said lock piece extends past said protrusion, after which said lock piece snaps back to its original undeflected position to engage said hooking portion with said protrusion to provide the locking engagement, and wherein said biasing part aids the snapping action to enhance said locking engagement while providing an audible sound and a tactile sensation as an indication that interfitting of said first and second housings is complete.

17. The electrical connector according to claim 16, wherein said enlarged hooking portion of said lock piece includes a tapered end surface, and said protrusion includes a tapered surface, such that as said first and second housings are interfitted, the tapered surface of said lock piece rides along the tapered surface of said protrusion to deflect said lock piece until said hooking portion extends past said protrusion.

18. The electrical according to claim 16, wherein said enlarged hooking portion of said lock piece is configured such that said lock piece must be manually deflected to enable said enlarged hooking portion to move to a position where it extends past said protrusion.

19. The electrical connector according to claim 18, wherein said biasing part is formed as a cantilever arm on said one of said first and second housings.

20. The electrical connector according to claim 19, wherein said cantilever arm includes a hemispherical projection adjacent a free end thereof, which projection engages an upper surface of said lock piece during interfitting of said first and second housings.

* * * * *

UNITED STATES PATENT AND TRADEMARK OFFICE

CERTIFICATE OF CORRECTION

PATENT NO. : 6,059,598

DATED : May 9, 2000

INVENTOR(S) : K. YAMASHITA et al.

It is certified that error appears in the above-identified patent and that said Letters Patent is hereby corrected as shown below:

At column 10, line 34 (claim 18, line 1) of the printed patent, after "electrical" insert ---connector---.

Signed and Sealed this

Tenth Day of April, 2001

*Attest:*

Nicholas P. Godici

NICHOLAS P. GODICI

*Attesting Officer*

*Acting Director of the United States Patent and Trademark Office*